US005226085A

United States Patent [19]

Di Francesco

[11] Patent Number: 5,226,085

[45] Date of Patent: Jul. 6, 1993

[54] METHOD OF TRANSMITTING, AT LOW THROUGHPUT, A SPEECH SIGNAL BY CELP CODING, AND CORRESPONDING SYSTEM

[75] Inventor: Renaud Di Francesco, Gentilly, France

[73] Assignee: France Telecom, France

[21] Appl. No.: 779,310

[22] Filed: Oct. 18, 1991

[30] Foreign Application Priority Data

Oct. 19, 1990 [FR] France ..... 90 12980

[51] Int. Cl.[5] ..... G10L 5/02; G10L 3/02; G10L 5/00

[52] U.S. Cl. ..... 381/51; 381/30; 381/31; 381/34; 381/36; 381/37

[58] Field of Search ..... 381/29-40, 381/51

[56] References Cited

U.S. PATENT DOCUMENTS

| | | | |
|---|---|---|---|
| 4,736,428 | 4/1988 | Deprettere et al. | 381/38 |
| 4,860,355 | 8/1989 | Copperi | 381/36 |
| 4,868,867 | 9/1989 | Davidson et al. | 381/36 |
| 4,899,385 | 2/1990 | Ketchum et al. | 381/36 |
| 4,910,781 | 3/1990 | Ketchum et al. | 381/36 |
| 4,932,061 | 6/1990 | Kroon et al. | 381/31 |
| 4,944,013 | 7/1990 | Gouvianakis et al. | 381/38 |
| 4,980,916 | 12/1990 | Zinser | 381/36 |
| 5,091,946 | 2/1992 | Ozawa | 381/36 |

FOREIGN PATENT DOCUMENTS 0379296 7/1990 European Pat. Off. .

*Primary Examiner*—Dale M. Shaw
*Assistant Examiner*—Kee M. Tung
*Attorney, Agent, or Firm*—Larson and Taylor

[57] ABSTRACT

A method is provided for transmitting a digital speech signal at low throughput. Coding is performed by code excited linear prediction in order to generate a code signal, a waveform being represented by an initial vector (O) of dimension L, from a filter for synthesizing by a reference waveform selected from a dictionary of reference vectors (v), relating to a criterion of minimum deviation min $\|\chi - H.v\|^2$, $\chi$ representing a target vector through perceptual weighting of the initial vector (O). A dictionary (Y) factorized as a product of basis vectors yi of n-ary form, which are corrected by a scale factor $\gamma i$ of distribution of the excitation energy, and a dictionary G(y) of gains gk, are established to represent the dictionary of the reference vectors (v), vk, i=gk.-$\gamma$.yi. The criterion is established by calculating C(gk, $\gamma$i.yi)=2gk$<\chi|H.\gamma i.yi>-gk^2$ formed of the scalar products and perceptual energies. To the initial vector (O) is assigned the optimal reference vector vk*, i*=gk*.$\gamma$i.yi represented by just the index values k*, i*.

12 Claims, 8 Drawing Sheets

R
$z^{+1}$
$h_0$
$h_1$
$h_{L-m-2}$
$h_{L-m-1}$
$h_{L-2}$
$h_{L-1}$
F
0
$I_1$
$I_m$
$I_{L-1}$
$SL_{-1}(D_0)=-h_0$
$SL_{-1}(D_1)$
$SL_{-1}(D_m+1)$
$SL_{-1}(D_m)$
$SL_{-1}(D_{L-2})$
$SL_{-1}(D_{L-1})$
Sy
S

10
$i^*, k^*$
$i^*, k^*$
discrimination
$i^*$
$k^*$
11
G
$g_k^*$
12
ROM
$i^*$
$\gamma_i^*$
12a
$\sigma \cdot g_k^* \cdot \gamma_i^*$
16
σ
13
Décomposition of $i^*$ to base n
0 —
14
Transcoding
$0 \rightarrow -\sigma g_k^*$
$1 \rightarrow 0$
2
$n \rightarrow +\sigma g_k^*$
15
$F_{(2)}$
s

METHOD OF TRANSMITTING, AT LOW THROUGHPUT, A SPEECH SIGNAL BY CELP CODING, AND CORRESPONDING SYSTEM

The invention relates to a method of transmitting, at low throughput, a speech signal by CELP coding, and to the corresponding system.

The technique of speech signal coding by the CELP ("Code Excited Linear Prediction") coding procedure is currently used and has formed the subject of much work. This technique for coding digital samples representing the speech signal is a hybrid coding technique in which the speech signal is modelled with linear prediction filters and the residues from this prediction.

Figure 1A:
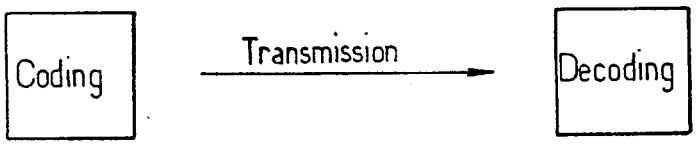
FIG.1a PRIOR ART
Figure 1B:
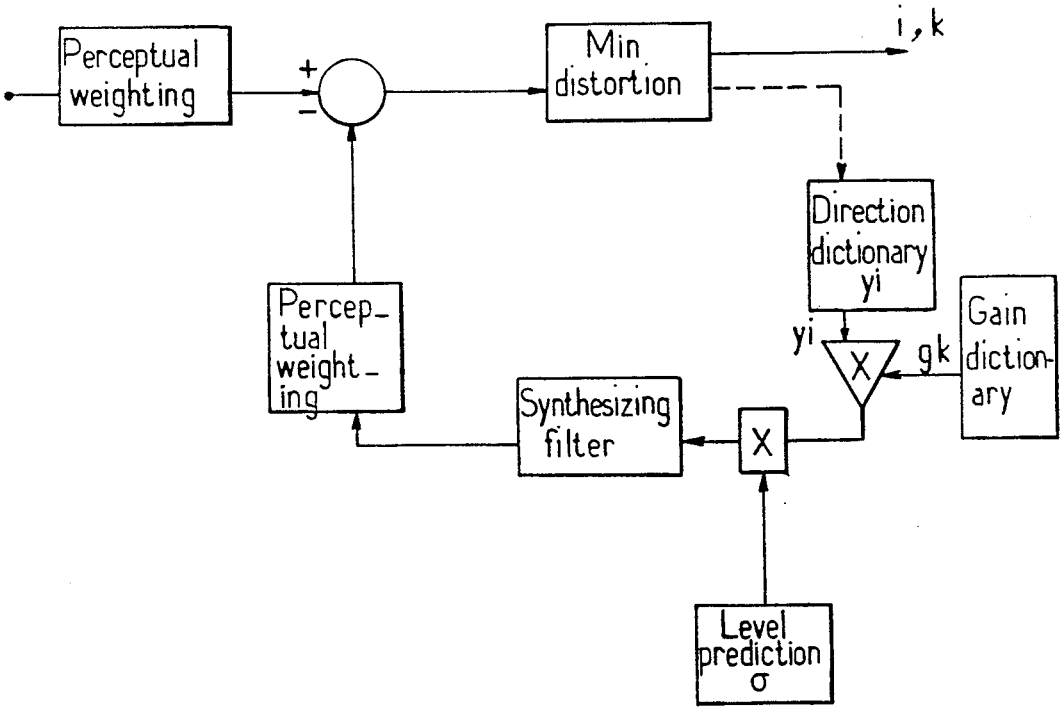
FIG.1b. PRIOR ART

Generally, CELP coders, as represented schematically in FIGS. 1*a* and 1*b*, test exhaustively all the elements of a list of waveforms. The waveform producing the best synthesis of the signal is adopted, and its index, or characteristic address, is transmitted to the decoder. This method is called analysis by synthesis. The list of waveforms, stored at coder and decoder level is called a dictionary.

The quality of a CELP coder depends strongly on the chosen dictionary and on the method of determining-/modelling the linear prediction filters used, these two parameters constituting two dependent degrees of freedom making it possible to adapt a particular CELP coder to the needs of a specific application.

Such a CELP coding technique is suitable for applications of coding at low throughput (between 4 and 24 kbits/s). It will be possible, for a more detailed description of this type of coding, to usefully refer to the article entitled "A robust and fast CELP coder at 16 Kbit/s", published by A. le Guyader, D. Massaloux and F. Zurcher Cnet Lannion France, in the journal Speech Communication No. 7, 1988.

Generally, in this type of coder, decoder, the digital signal to be analyzed, transmitted and reconstituted is partitioned into blocks, or frames. Each block containing L values is regarded as a vector from a vector space of dimension L. The current excitation signal consisting of a vector v, read from the dictionary of waveforms, must minimize a perceptual distortion criterion of the form: min $\|\chi - H.v\|^2$, in which $\chi$ designates a target signal resulting from the original signal 0 to be transmitted after perceptual weighting and H designates a pulse-response matrix of dimension $L \times L$ resulting from the product of the transfer functions of the synthesizing filter and of the perceptual weighting. It will be recalled that the purpose of perceptual weighting, relative to coding noise, similar to white noise, is to relate, in the frequency domain, the contribution of this latter to the signal actually perceived The matrix H is a triangular matrix of the form:

$$H(L) = \begin{bmatrix} h0 & 0 & 0 & 0 & 0 & 0 \\ h1 & h0 & 0 & 0 & 0 & 0 \\ h2 & h1 & h0 & 0 & 0 & 0 \\ h3 & h2 & h1 & h0 & 0 & 0 \\ h4 & h3 & h2 & h1 & h0 & 0 \\ - & - & - & - & - & - \\ h_{L-1} & h_{L-2} & h3 & h2 & h1 & h0 \end{bmatrix}$$

During the coding procedure, each reference vector vi is associated with an adaptive gain value gk taken from a dictionary of gain values G, this making it possible, following application of the gain gk to the vector vi in order to form a vector vk,i, to satisfy the above-mentioned minimum distortion criterion.

So as to reduce the complexity of the very numerous calculations which depend on the dimension L of the vectors and on the throughput of the speech signal, it has been proposed in certain works to use as reference vector, so as to produce the excitation signal, vectors the value of whose components are only the values +1, 0 or −1, the dictionary of the vectors then being built up in the form of a dictionary of ternary vectors. Such a use, in a coding procedure of CELP type, of ternary vectors of this type was mentioned in European Patent Application EP 0,347,307, published on Dec. 20, 1989.

However, in such a coding procedure, it will be noted that all the reference vectors necessarily contain the same energy. Furthermore, the search for the optimum reference vector or sequence cannot be reduced to the calculation of purely scalar products except in the case where the auto-correlation is itself normalized and exhibits null terms whose spacing corresponds to the non null components of the reference vectors or sequences.

Such a mode of operation does not therefore make it possible to take into account, as reference vector, all of the possibilities of combinations of ternary values of components of reference vectors, it not being possible in all cases for the minimizing of the distortion criterion to be optimal.

A purpose of the present invention is to remedy the abovementioned disadvantages, so as, in particular, to simplify the calculations by introducing as reference vector, in the dictionary of reference vectors, or directions, substantially all the combinations of the n-ary values of the components of the vectors, n being an odd number.

Another purpose of the present invention is the implementation, prior to the conventional procedure for applying an adaptive gain to each of the reference vectors, of a correction procedure by application of a scale factor, introducing the spread in the energy of the excitation signal as a function of the frequency spectrum of the latter, so as to take account of the nonuniformity in the energy distribution of the signal in the frequency domain.

Another purpose of the present invention is finally the implementation of a method for transmitting, at low throughput, a speech signal in which, each reference vector, constituting the excitation signal, can be regenerated at decoder level from just the index or address values of the optimal reference vector satisfying the minimum distortion criterion at coder level, this having the effect of considerably simplifying and reducing the manufacturing costs of the abovementioned decoders.

The method of transmitting a speech signal at low throughput according to the present invention comprises a procedure for coding digital samples of speech by code excited linear prediction, in order to generate a code signal, a procedure for transmitting the code signal and a procedure for decoding the received code signal. The coding procedure corresponds to a procedure in which a waveform represented by a sample block comprising L sample values and constituting an initial vector (o) of dimension L is represented, on the basis of a synthesizing filter, by a reference waveform chosen from a dictionary of reference waveforms each forming a reference vector (v) relating to a criterion of minimum square deviation of the said initial vector (o) in relation to the said waveform or reference vector (v), min $\|\chi - H.v\|^2$, where $\chi$ represents a target vector obtained by perceptual weighting of the said initial vector (o) and H a pulse-response matrix of dimension $L \times L$ resulting from the product of the synthesizing filter and of the linear perceptual weighting. This procedure is notable in that the selection criterion consists in establishing a dictionary factorized as a product of a first dictionary Y of basis vectors yi, of n-ary form $\{-n/2, \ldots, o, \ldots n/2\}$, n odd, of dimension L, these basis vectors each being corrected by a scale factor $\gamma i$ which takes account of the distribution of excitation energy in the frequency domain of the signal and of a second dictionary G(y) of gains gk, in such a way as to thus represent the dictionary of waveforms or reference vectors, each reference vector satisfying the relation $vk,i = gk.\gamma i.yi$. It will be noted that the value n/2 corresponds to the integer division of n by 2.

The minimum value of the square deviation min $\|\chi - gk.H.\gamma i.yi\|^2$ is then established by calculating the maximum of $C(gk,\gamma i.yi) = 2\,gk\langle\chi|H.\gamma i.yi\rangle - gk^2 \|H.\gamma i.yi\|^2$ by calculating all the scalar products $\langle\chi|H.\gamma i.yi\rangle$ and all the perceptual energies $\|H.y\|^2$, this making it possible to assign to the initial vector (o) the corresponding optimal reference vector $vk^*,i^*$ with $vk^*,i^* = gk^*.\ \gamma i^*.yi^*$, this optimal reference vector being represented by just the index values $k^*, i^*$ satisfying the criterion min $\|\chi - gk.H.\gamma i.yi\|^2$.

The procedure for transmitting a speech signal at low throughput, according to the present invention, consists in transmitting, as code signal, just the values of the indices $k^*,i^*$ representing each optimal reference vector $vk^*,i^*$.

The procedure for decoding a coded speech signal transmitted at low throughput according to a code signal, in accordance with the purpose of the present invention, is notable in that, so as to ensure the decoding of the code signal, this procedure consists in distinguishing the values of the indices $k^*,i^*$ constituting the code signal, in decomposing the value of the index $i^*$, representing the optimal reference vector, to base n in order to regenerate the corresponding basis vector $yi^*$, in performing, on the basis of the value of the index $i^*$, of the corresponding scale factor $\gamma i^*$ and of the corresponding adaptive gain $gk^*$, a correcting of the corresponding regenerated basis vector in order to constitute the regenerated reference vector $vk^*,i^*$. A synthesizing filtering operation is performed on the regenerated reference vector $vk^*,i^*$ in order to generate the reconstructed speech signal.

The method which is the subject of the present invention, the procedures for coding, transmitting and decoding, and the system and circuits for coding, transmitting and decoding, making possible the implementation of this method, advantageously find application in the transmission of speech signals at low throughput, in particular between moving bodies for example.

Figure 2A:
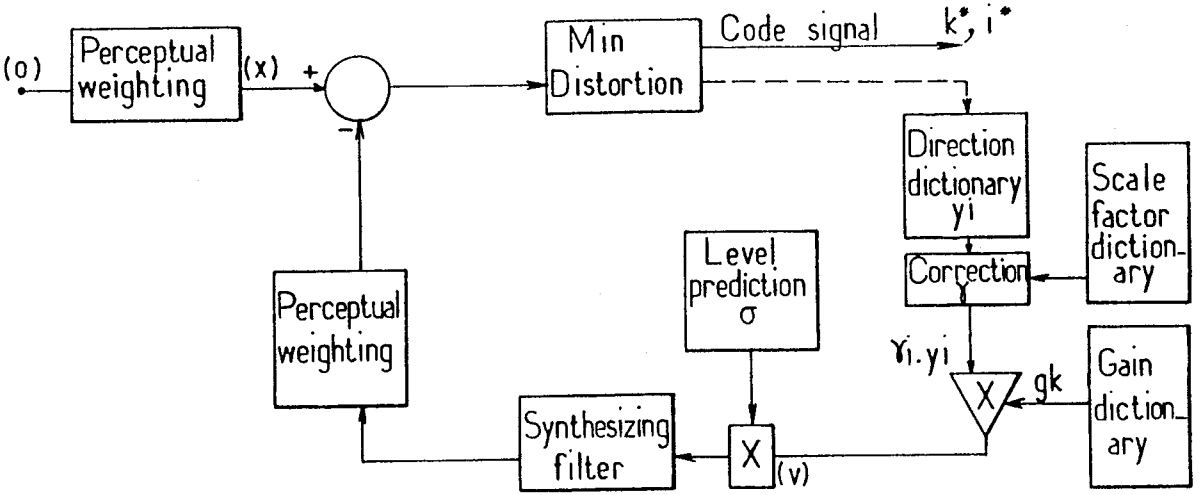
Figure 2B:
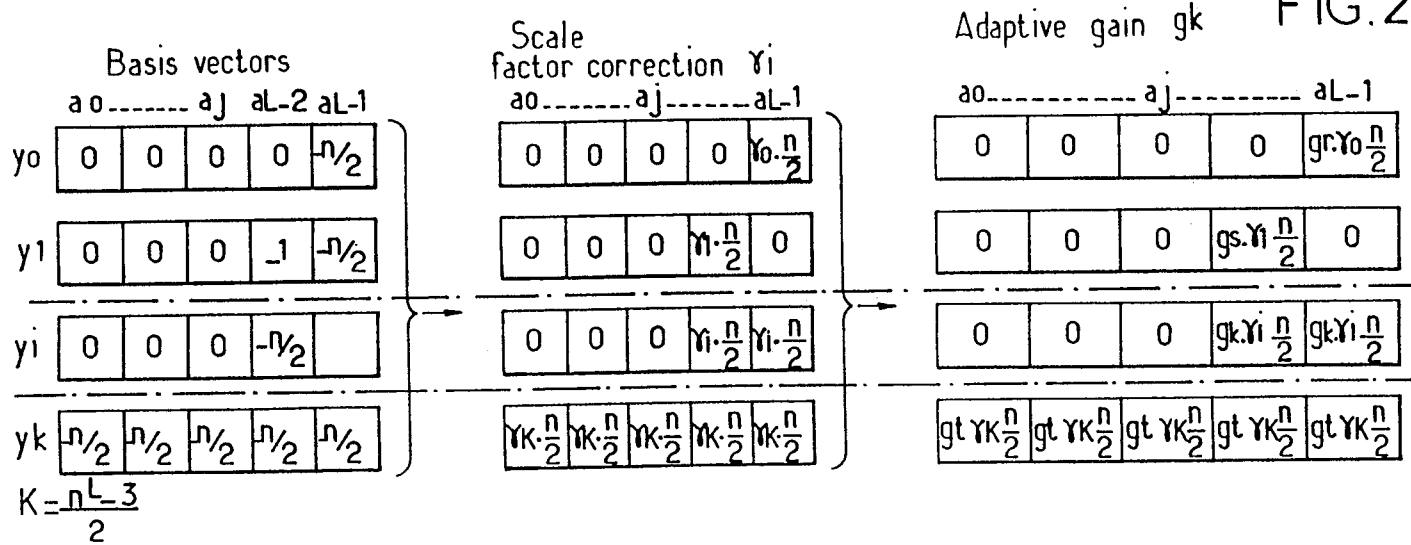
Figure 3A:
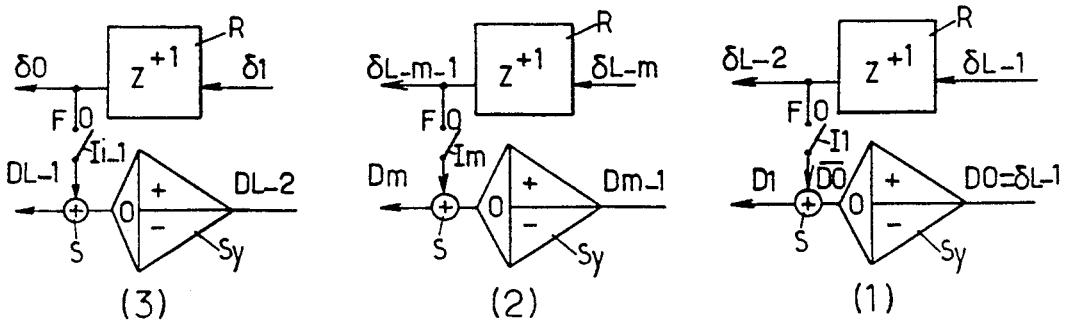
Figure 3B:
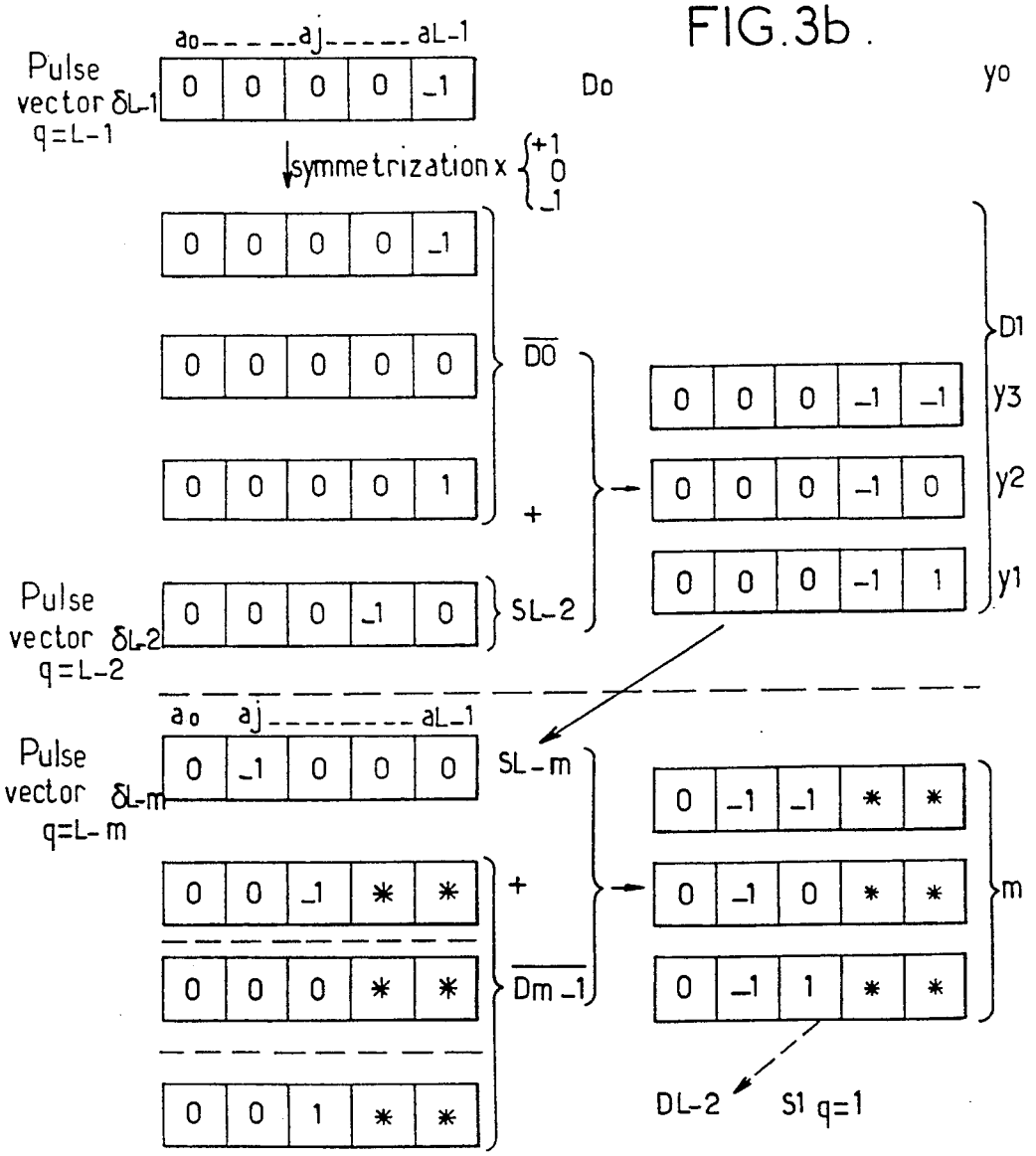
Figure 4:
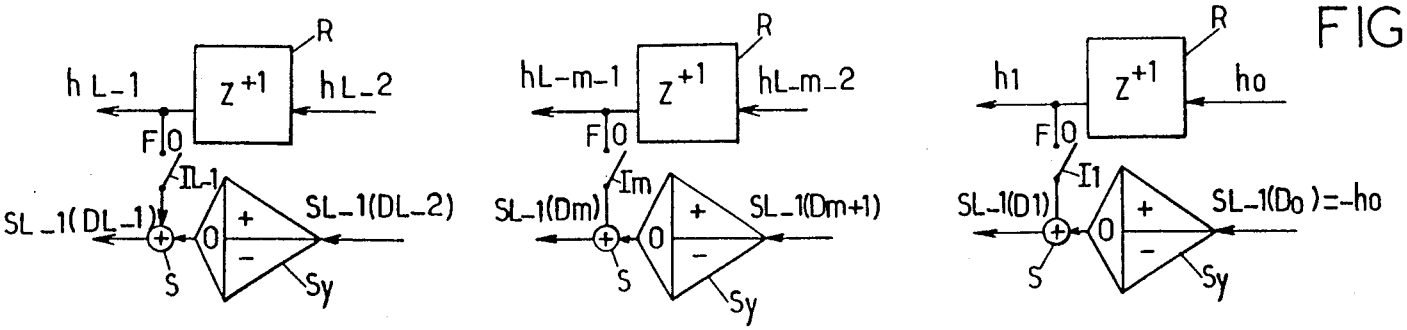
Figure 9:
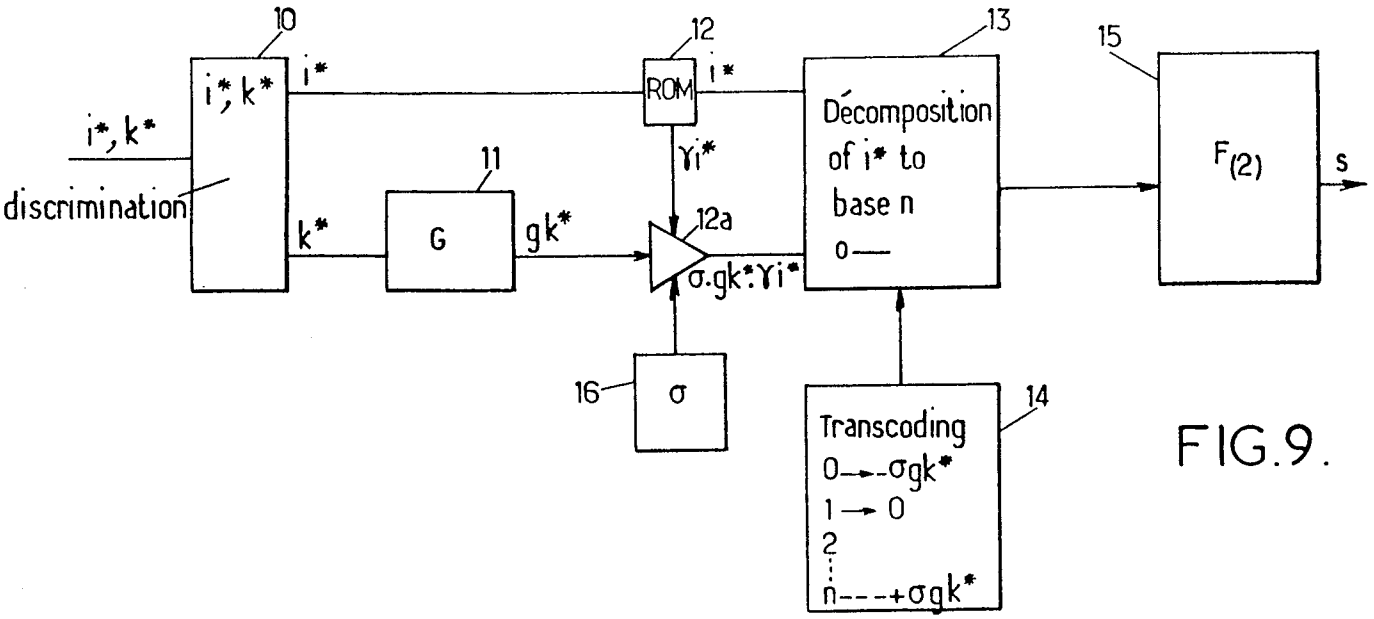
Figure 5A:
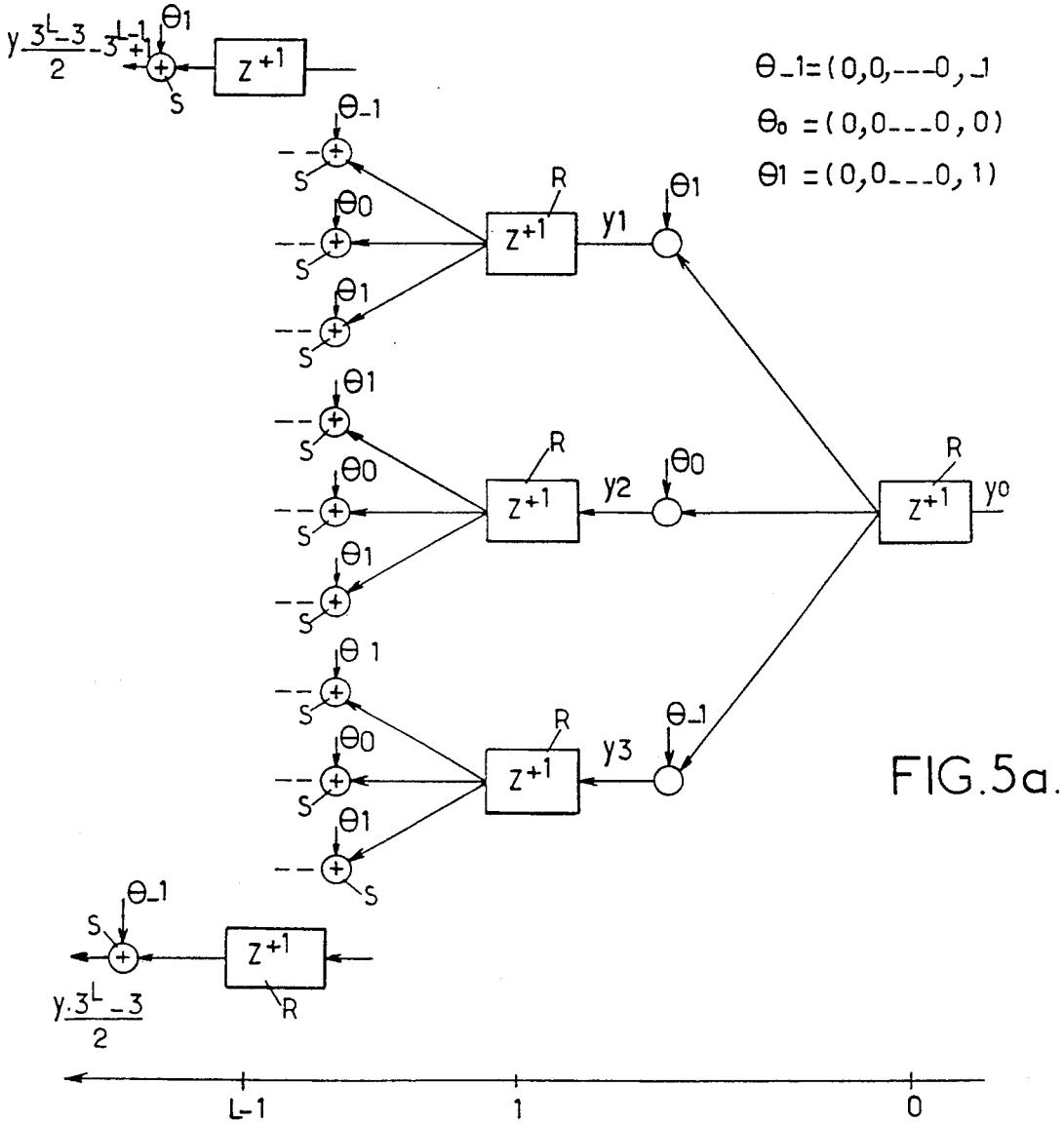
Figure 5B:
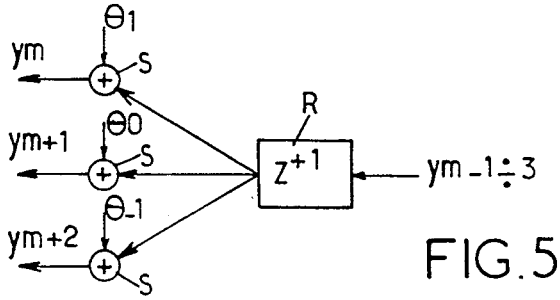
Figure 5C:
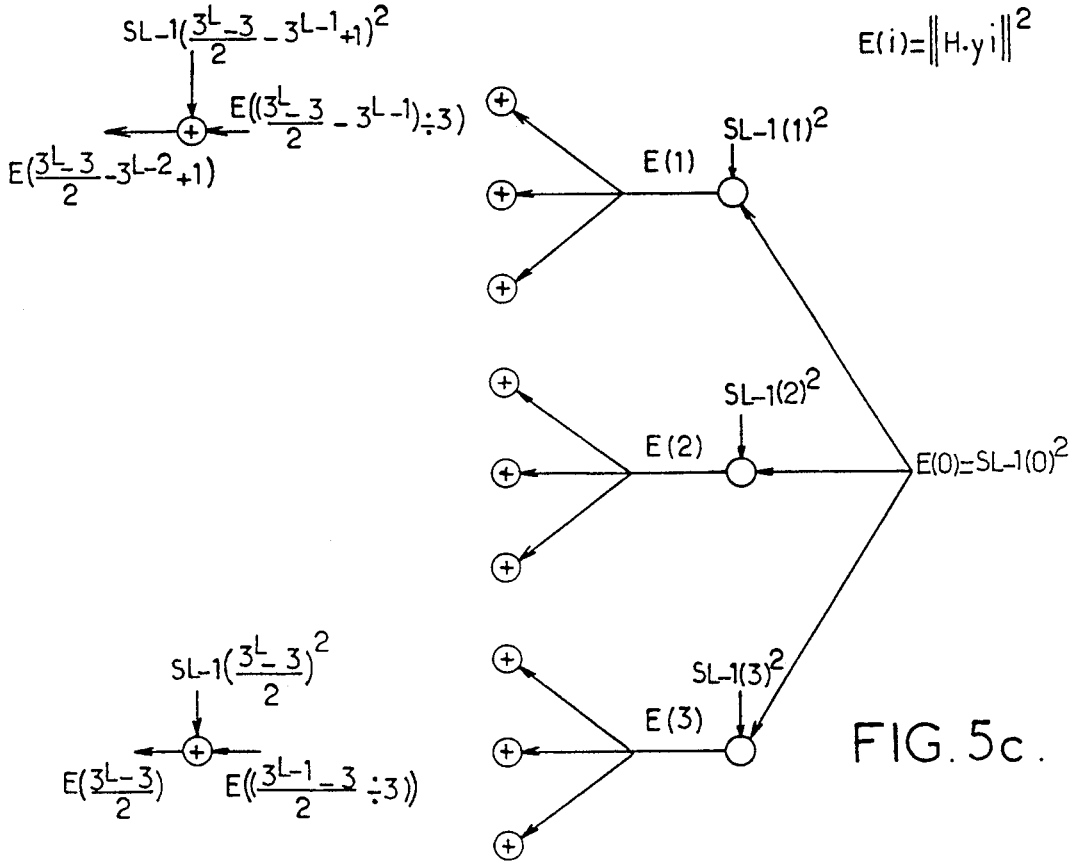
Figure 5D:
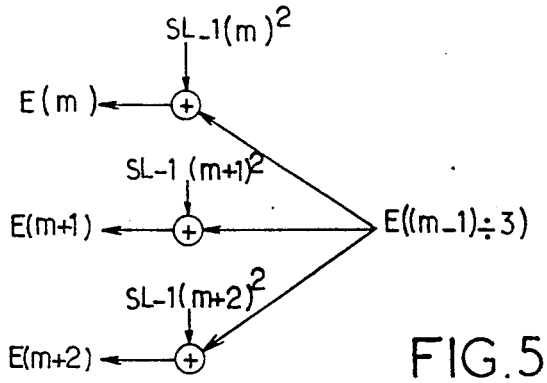
Figure 6:
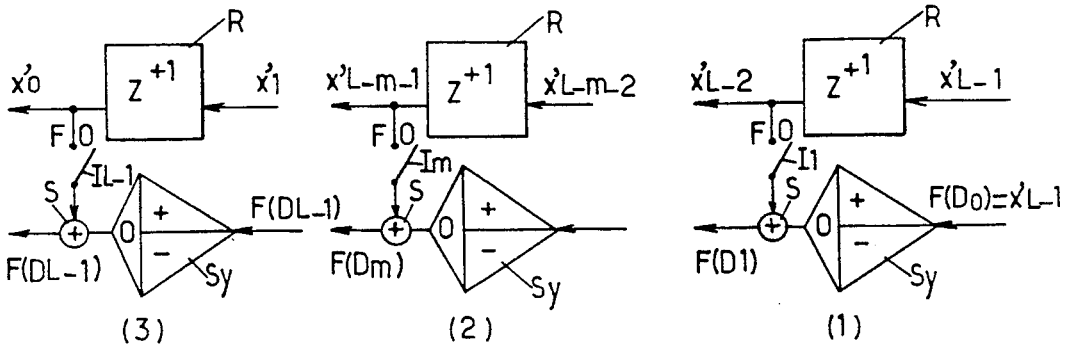
Figure 7:
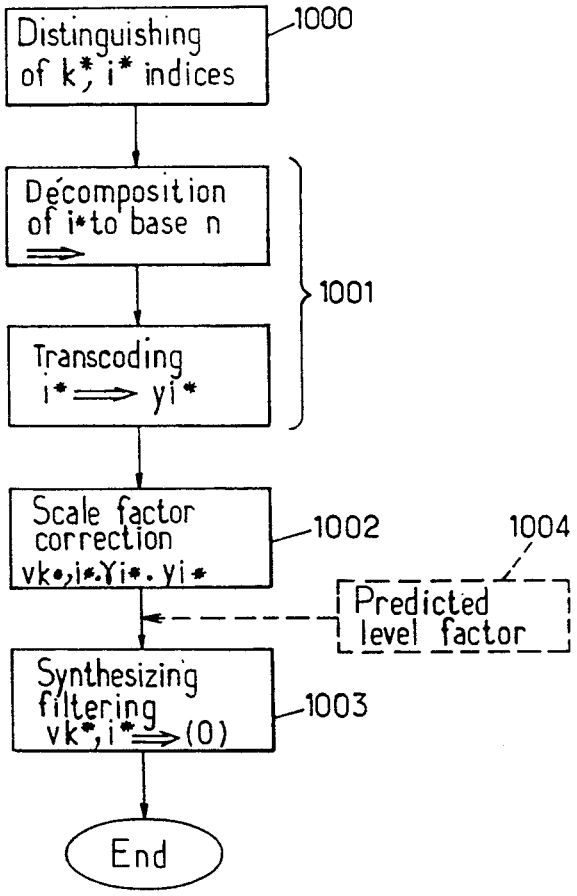
Figure 8:
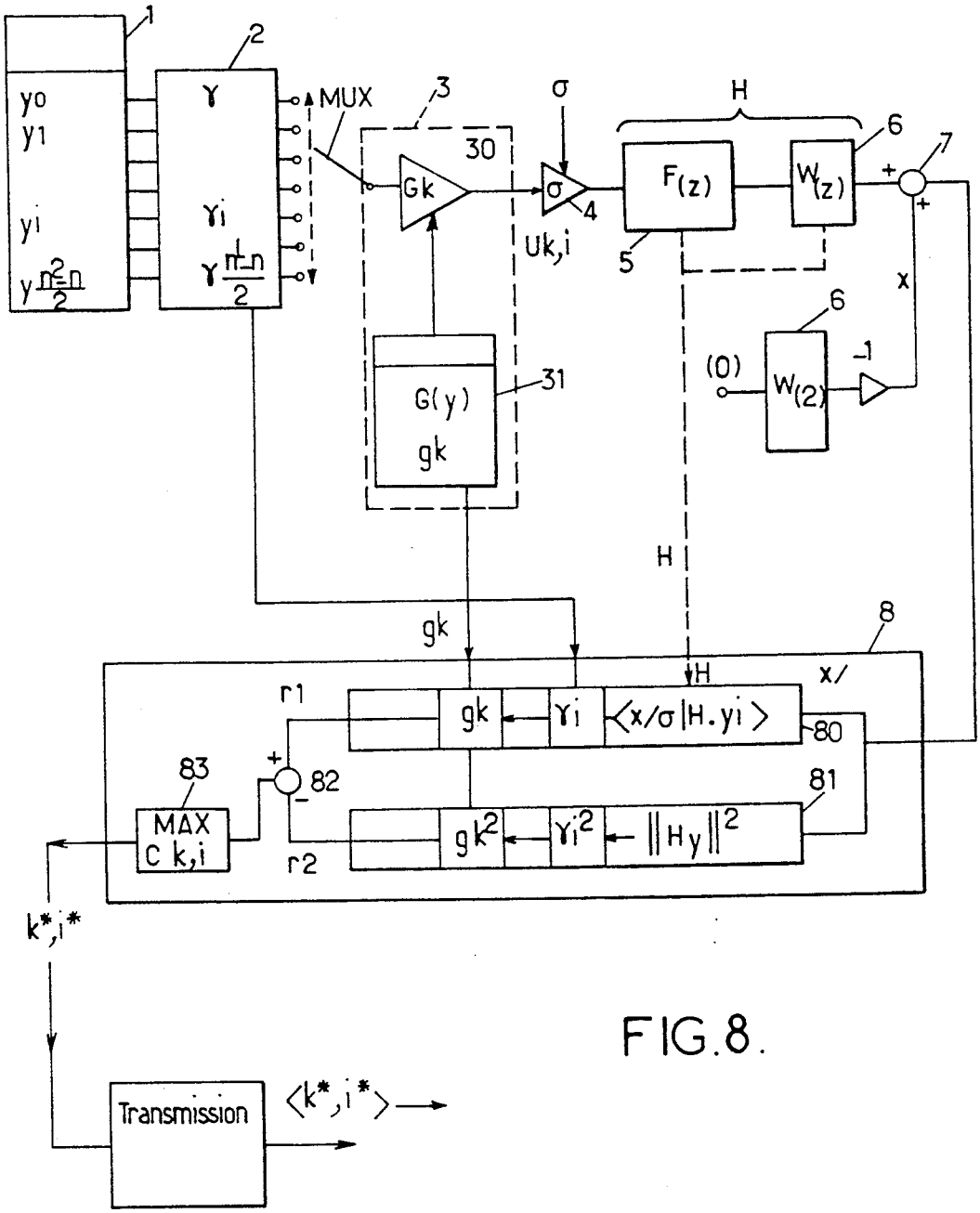

The invention will be better understood on reading the description below and on observing the drawings in which, apart from FIGS. 1*a* and 1*b* relating to the prior art, FIG. 2 represents in location a), on the one hand, the processing steps in a coding procedure in accordance with the purpose of the present invention, and in location b), on the other hand, the operations performed on the basis vectors in the steps represented in location a), for the n-ary vectors, FIG. 3*a* represents in locations 1, 2 and 3 the modules for processing pulse vectors constituting favored basis vectors, in a recursive-type processing operation making it possible to generate a first dictionary of basis vectors, FIG. 3*b* represents in succession the operations performed on the basis vectors in order to generate, iteratively, the first abovementioned dictionary of basis vectors, in a particular case in which n=3, the basis vectors being ternary vectors, FIG. 4 represents in similar manner to FIG. 3*a*, 3*b* a procedure for calculating the pulse response for all the ternary vectors yi exciting the synthesizing filter and the perceptual weighting filter in cascade having the transfer function H, FIG. 5 represents at its various locations a), b), c) and d) charts representing the procedures for calculating the perceptual energies of the ternary vectors, from the partial pulse responses of the transfer function H, FIG. 6 represents charts representing the procedures for calculating the scalar products, FIG. 7 represents a flow diagram of the steps for processing the optimal index values $k^*,i^*$ received during the decoding procedure, FIG. 8 represents an overall diagram of a coding circuit in a system for transmitting speech at low throughput in accordance with the purpose of the present invention, FIG. 9 represents an overall diagram of a decoding circuit in a system for transmitting speech at low throughput in accordance with the purpose of the present invention.

The method of transmitting a speech signal at low throughput, which is the subject of the present invention, will firstly be described in connection with FIGS. 2*a* and *b*.

According to the abovementioned FIG. 2, the method which is the subject of the invention comprises a procedure for coding digital samples of speech by code excited linear prediction. This procedure makes it possible to generate a code signal. The method further comprises a procedure for transmitting the code signal and a procedure for decoding the code signal received.

According to the abovementioned FIG. 2, the coding procedure corresponds to a procedure in which a waveform represented by a sample block comprising L sample values, or frames, constitutes an initial vector denoted by o of dimension L, this vector being represented, as is the corresponding waveform, on the basis of a filter for synthesizing by a reference waveform, denoted by v, selected from a dictionary of reference waveforms each forming one abovementioned reference vector. The selection is performed from a criterion of minimum square deviation of the initial vector o in relation to the waveform or reference vector v, this criterion being written: min $\|\chi - H.v\|^2$.

In this relation $\chi$ represents a target vector obtained by perceptual weighting of the initial vector o and H represents a pulse-response matrix of dimension $L \times L$ resulting from the product of the synthesizing filter and of the abovementioned linear perceptual weighting.

According to the method which is the subject of the present invention, the coding procedure is such that the selection criterion consists in establishing a dictionary factorized as a product of a first dictionary Y of basis vectors denoted by yi. Each basis vector is a basis vector of n-ary form, that is to say the components aj of these basis vectors, with j∈[0, L−1], can take n different discrete values. Generally, each value of the components aj can take a value included in the group [−n/2, . . . 0, . . . n/2] with an increment of 1, n being odd, n/2 representing the integer division of n by 2.

According to an advantageous characteristic of the method which is the subject of the present invention, each basis vector yi is corrected by a scale factor γi taking into account the distribution of the excitation energy in the frequency domain of the signal. It will be noted that in the most general way, the scale factors γi are determined, experimentally, from a database, the database being built up by recording meaningful speech samples over several hours for example and for several speakers of one language of expression or of several distinct languages, experience showing that the diversity in languages of expression only comes into the determination of the abovementioned scale factors γi to second degree. A more detailed description of a table of scale factors γi for ternary vectors of dimension L=5 will be given later in the description.

It will be noted simply that, according to this principle, the scale factors γi are determined for each corresponding basis vector yi through a procedure for identifying each basis vector γi in a delocalized sequence of L successive recursive speech samples from the database, sorting the smallest matching coefficients and averaging a number u of identifying or matching coefficients in order to obtain the corresponding scale factor γi associated with the abovementioned basis vector yi.

The factorized dictionary mentioned earlier is likewise built up through a second dictionary constituting the abovementioned product, this second dictionary being denoted by G(y) and being formed by a dictionary of gains gk. The factorized dictionary thus constitutes a reference vector or waveform dictionary. Each reference vector thus satisfies the relation $v_{k,i}$=gk.γi.yi.

It will of course be noted, as represented in FIG. 2*a*, that the correction operation performed by applying the scale factor γi does not constitute a simple weighting of the components aj of each basis vector yi since each scale factor coefficient γi represents the distribution of the excitation energy in the frequency domain of a speech signal.

As has been represented in location a) of FIG. 2, the method which is the subject of the invention consists therefore in establishing the minimum value of the square deviation min $\|\chi-gk.H.\gamma i.yi\|^2$ by calculating a function denoted by: C (gk,γi.yi)=2 gk $<\chi|H.\gamma i.yi>-gk^2\|H.\gamma i.yi\|^2$ by calculating all the scalar products $<\chi|H.\gamma i.yi>$ and all the perceptual energies $\|H.y\|^2$.

The abovementioned calculation then makes it possible to assign to the initial vector o the corresponding optimal reference vector denoted by vk*,i* with=gk*.γi*.yi*. Of course, in accordance with a particularly interesting purpose of the present invention, this optimal reference vector is represented by just the values of the index parameters k*,i* satisfying the abovementioned criterion: min $\|\chi-gk.H.\gamma i.yi\|^2$.

A more detailed description of the operations performed at each basis vector yi level, these basis vectors being n-ary vectors of dimension L the value of whose components $a_j$ is at most the value n/2 or possibly −n/2, with integer values and with an increment of 1, will be given in connection with location b) of FIG. 2.

In the abovementioned location b), the basis vectors denoted by y0, y1, yi, yK with $$K=\frac{n^L-3}{2}$$

have been represented in succession, the value of each component being one of the values of the n-ary form. The correction has then been represented by application of the scale factor γi which, for the reasons mentioned earlier, does not constitute a simple weighting similar to the adaptive application of the gain gk, there being applied to each value of the components aj of the basis vectors yi the corresponding scale factor γi determined under the conditions mentioned earlier. At the same location b) the application of the adaptive gain gk has finally been represented, each component aj of the basis vectors yi then being multiplied by the product gk.γi.

It will evidently be understood that, in the implementation of the coding procedure as represented in locations a) and b) of FIG. 2, mentioned earlier, the minimum value of the square deviation min $\|\chi gk.H.\gamma i.yi\|^2$ is evaluated by selecting the corresponding gain element gk from the second dictionary G(y) making it possible to minimize the difference |g−gk*| where g satisfies the relation:

$$g=\frac{<\chi\,|H\cdot\gamma i\cdot yi>}{\|H\cdot\gamma i\cdot yi\|^2}$$

A more detailed description of the arrangement of the basis vectors yi in order to build up the dictionary or first dictionary Y of dimension L of basis vectors yi will now be given in connection with FIGS. 3*a* and 3*b*.

Generally, it will be understood that the dictionary Y of basis vectors yi of n-ary form [−n/2, . . . , 0, . . . n/2] of dimension L comprises all the basis vectors whose L components have the abovementioned n-ary values, with the exception of the null vector. Generally, the index i of the basis vectors is made equal to the base n value of each basis vector after transcoding of the values {−n/2 . . . , 0 . . . n/2} into corresponding values (0,1,2 . . . n). It will thus be understood that the basis vectors yi of n-ary form are arranged according to their index i, the value of this index i being the to base n value of each vector.

It will likewise be understood that the set of basis vectors yi constituting the dictionary Y is defined from the n/2.L pulse vectors of which a single component aj of order j, with j∈[0,L-1], is equal to −1, −2, . . . −n/2. With each pulse vector are associated the allied basis vectors having values of components of identical order q≦j, each vector allied to a pulse vector of rank q, with q=j for aj differing from 0, being obtained by linear combination of the pulse vector of rank j=q and of the pulse or allied vectors of higher rank j=q'.

A more detailed description of the implementation of the dictionary of basis vectors yi in the case of ternary vectors and of the manner of generating these basis vectors will be given in connection with FIGS. 3*a* and 3*b*, it being possible to generate basis vectors of dimension L and of n-ary form according to the same principle without exceeding the scope of the subject of the present invention.

In the FIGS. 3*a* and 3*b* operator cells have been respectively represented making it possible to generate, from the pulse vectors defined earlier and from subdictionaries constituted by the relevant pulse vector and the allied vectors corresponding to each pulse vector, the complete dictionary comprising the union of the set of all the sub-dictionaries.

Each operator such as represented in FIG. 3*a* comprises an operator termed the delay operator R whose transfer function is denoted by $Z^{+1}$, according to the conventional notation for a Z-transform, a symmetrizing operator denoted by Sy whose function is to multiply the components of all vectors presented to its input by the value +1, by the value 0 then by the value −1, and an adder, denoted by S, receiving the output from the delay operator R and from the symmetrizer Sy. The adder S receives the output from the delay operator R via a switch I, in position F, or the null vector [0,0,0,0,0] of dimension L in position 0. The operators represented in FIG. 3*a* consist of a single operator represented at 1), 2) and 3) at different steps of a processing procedure for generating the basis vectors yi of the abovementioned dictionary Y.

At the start of the procedure for generating the basis vectors yi, such as is represented in location 1) of FIG. 3*a*, the initial pulse or pulse vector δL−1 is present at the input of the delay operator R. The symmetrizer Sy is then fed by a sub-dictionary denoted by $\overline{DO}$, which initially consists of the abovementioned pulse vector δL−1. The symmetrizer Sy delivers a symmetrical sub-dictionary denoted by $\overline{DO}$, such as represented in FIG. 3*b*, and the adder S which receives the pulse vector δL−2 delivered by the delay operator R, pulse vector of rank q=L−2, or the null vector, and the symmetrical sub-dictionary $\overline{DO}$, delivers at output the. dictionary D1 consisting of the basis vectors y0, y1, y2 and y3. It will of course be noted that, as represented in FIG. 3*b*, with the pulse vector δL−2 is associated the sub-dictionary D1 formed by the vectors y1, y2 and y3 allied to the pulse vector δL−2 and by the initial pulse vector δL−1 forming the basis vector y0, as well as the null vector. Of course, in a recursive manner such as represented at location 2) of FIG. 3*a*, the operator making it possible to generate the basis vectors yi is such that it receives at delay operator R level the pulse vector δL−m, at symmetrizer Sy level, the dictionary denoted by D m−1 formed recursively like the dictionary D1, the adder S such as represented at location 2) of the same FIG. 3*a* then delivering from the abovementioned pulse vector δL-m−1 delivered by the delay operator R or from the null vector and through the sub-dictionary $\overline{D\ m-1}$, the sub-dictionary D m.

It is thus possible by iteration and recursively to generate from the set of pulse vectors, such as is described earlier, the allied vectors and the corresponding sub-dictionaries, then finally the complete dictionary. It should be noted that, in FIG. 3*b*, the *s represented at component aj level with regard to the procedure for processing level m correspond to values 0, −1 or +1 when the vectors are ternary vectors. Of course, in the case of n-ary vectors, the *s represent values included between −n/2 and +n/2, under the conditions mentioned previously.

It will be noted that the overall ternary dictionary, the sum of union of all the sub-dictionaries of intermediate level m, up to L, may be obtained for just the positive or negative values of the components aj, the overall dictionary then being obtainable by symmetrization via a symmetrizing operator such as Sy.

In the same way, calculation of the partial response at an instant t=L−1, that is to say at a relative instant corresponding to the occurrence of the pulse vector δL−1, of the system H constituted by the synthesizing filter and by the perceptual weighting filter excited by the ternary basis vectors yi can be described with the aid of the cited operators. The partial response at the instant t=L−1 is denoted by SL-1(yi).

At the first calculation operator level, denoted by 1 in FIG. 4, this operator is such that the pulse responses of the system H at the relative time 0, 1, 2, L−1, that is to say the values h0, h1, hL−2, hL−1, are applied to the abovementioned operator.

It will be recalled that here the operator SL−1 also represents the addition to each element hL−m−1 or to the zero value of all the partial responses at t=L−1 of the vectors of the symmetrized dictionary delivered by the symmetrizer Sy of level m (sic).

There is thus obtained $S_{L-1(Dm)}$ the set of responses t=L−1 of the vectors of Dm.

The symmetrizing operator Sy multiplies the elements of $S_{L-1(Dm-1)}$ by +1, 0, −1 and produces, as described earlier, the union of the distinct elements obtained. Finally, the last operator represented at 3 in FIG. 4 furnishes the response at t=L−1 of the ternary vectors yi whose first coordinate is −1.

It will be noted that the response of the linear system of the matrix H to the ternary vectors which are applied to it may therefore be produced according to the same architecture as earlier by applying the linear transformation H to each node of this architecture.

The perceptual energies of the ternary vectors may then be deduced from just the previously described partial responses at t=L−1.

Thus, the response of the matrix H to excitation by a vector yi can be written:

$$Hyi = \overset{H}{\begin{bmatrix} h0\ 0 \\ h1\ h0 \\ h2\ h1 \\ h3\ h2 \\ h4\ h3 \\ hL-1 \ldots h1h0 \end{bmatrix}} \overset{yi}{\begin{bmatrix} yi(o) \\ yi(1) \\ \cdot \\ \cdot \\ \cdot \\ yi(L-1) \end{bmatrix}} = \overset{H \cdot yi}{\begin{bmatrix} h0yi(o) \\ h1yi(1) \\ \cdot \\ \cdot \\ \cdot \\ hL-2yi(o) + \ldots + h0yi(L-2) \\ hL-1yi(o) + \ldots + h0yi(L-1) \end{bmatrix}}$$

$$= \begin{bmatrix} 0 \\ \cdot \\ \cdot \\ \cdot \\ SL-1(yi) \end{bmatrix} + \begin{bmatrix} h0yi(o) \\ h1yi(o) + h0yi(1) \\ \cdot \\ \cdot \\ \cdot \\ hL-2yi(o) + \ldots + h0yi(L-2) \\ 0 \end{bmatrix}$$

Thus, by definition the response at the relative instant $t=L-1$, denoted by $SL-1(yi)$, is the coordinate of order $L-1$ of Hyi.

However, it is possible to write:

$$y'i = \begin{bmatrix} h0yi(o) \\ h1yi(o) + h0yi(1) \\ \cdot \\ \cdot \\ \cdot \\ h_{L-2}yi(o) + \ldots + h0yi(L-2) \\ 0 \end{bmatrix}$$

and $$y''i = \begin{bmatrix} 0 \\ h0yi(o) \\ h1yi(o) + h0yi(1) \\ \cdot \\ \cdot \\ \cdot \\ h^{L-2}yi(o) + \ldots + h0yi(L-2) \end{bmatrix} = H \begin{bmatrix} 0 \\ yi(o) \\ yi(1) \\ \cdot \\ \cdot \\ \cdot \\ yi(L-2) \end{bmatrix}$$

and

It will be noted that y'i and y''i have the same norm and, denoting the elementary delay operator by $z^{-1}$, it is possible to prove the relationship below:

$$\| y'i \|^2 = \| y''i \|^2 = \| H.z^{-1}yi \|^2$$

$$\| H.yi \|^2 = S_{L-1}(yi)^2 = \| H.z^{-1}yi \|^2$$

However, if yi belongs to Dm, $z^{-}$.yi belongs to $Dm-1$.

An iterative procedure therefore makes it possible to calculate the perceptual energies for D0, then D1, then $DL-1$. The initial value is for $D0=\delta\ L-1$, that is to say the pulse vector previously represented in FIG. 3, $h0^2$.

A basic diagram of the procedure for numbering and calculating the various entities implemented by the selection criterion in accordance with the subject of the present invention will be described in connection with FIGS. 5*a* and 5*b*.

Generally, as represented in FIG. 5*a*, the basis vectors yi such as already described earlier can be generated according to the global generation chart at the rate of $3^0=1$ vector is generated at level 0, the vector y0, $3^1$ are generated at level 1, vectors y1, y2 and y3, and so on, $3^{L-1}$ basis vectors at level $L-1$.

The elementary untripling cell is represented in FIG. 5*b* on the basis of pulse vectors denoted by $\theta-1$, $\theta 0$ and $\theta 1$. It will be noted that adding the pulse vectors $\theta 1$, $\theta 0$, $\theta-1$ amounts to replacing the last coordinate of the incoming basis vector by the component values $+1$, 0 or $-1$.

It will be noted that the architecture as represented in FIG. 5*a* and 5*b* is that of a linear structure of ternary charts. For an n-ary structure an n-ary chart is obtained.

It is likewise possible to obtain a practical embodiment for calculating the expression $\| H.yi \|^2 = SL-1(yi)^2 + \| H.z^{-1}yi \|^2$ by virtue of the analog architecture below. This architecture will be described in connection with FIGS. 5*c* and 5*d*.

E(i) is called the expression $E(i) = \| H.yi \|^2$.

As has been represented in FIG. 5*c*, the global chart for obtaining the energies is traversed from right to left, the initial energy E (O) being at $SL-1(O)^2$.

The elementary cell making up the chart represented in FIG. 5*c* is represented in FIG. 5*d*.

It will be noted that the numbering of the vectors, that is to say the allocating of their basis vector index i, may correspond either to a forward ternary numbering, or to a backward numbering, any index p of the forward numbering of a ternary vector satisfying the corresponding relation in backward p' numbering $p'=3^L-p-1$. It will of course be understood that all the calculations can be performed either with forward numbering or with backward numbering, the latter being preferred. It is then possible to transmit the backward index values for example or the forward index values over the transmission line as will be described later in the description.

It will further be noted that, in accordance with earlier practices in the field of CELP type coding, prior to the synthesizing filtering each reference vector vk*,i* may advantageously be weighted by a predicted level factor, denoted by $\sigma$. This predicted level factor $\sigma$ represents the average energy of the excitation signal estimated over at least three successive earlier excitation vectors. Such an operation on the components aj of each reference vector will not be described since it corresponds to an operation known to the expert.

A more detailed description of a procedure for calculating scalar products of the form $<2\chi|H.yi>$ where $x=\chi/\sigma$ for all the basis vectors yi will now be described in connection with FIG. 6.

It will in fact be noted that in view of the predicted level factor $\sigma$ actually introduced into the coding procedure which is the subject of the present invention, the calculating of the expression $<2\chi|H.yi>$ for all the ternary vectors yi is in fact involved.

The preceding expression is then calculated by filtering the expression $2\chi/\sigma$ by the transposed matrix of the matrix H, namely $^tH$.

This expression can be written:

$$< \frac{2}{\sigma} x \Big| Hyi > = < H^t \cdot \left( \frac{2}{\sigma} x \right) \Big| yi >$$

Setting $x' =$ $$x' = H^t \left( \frac{2}{\sigma} x \right) =$$

$$\begin{bmatrix} \frac{2 \cdot (h0x(o) + h1x(1) + \ldots + h_{L-1}x(L-1)}{\sigma} \\ \frac{2\,(h0x(1) + h2x(2) + \ldots + h_{L-2}x(L-1)}{\sigma} \\ \cdot \\ \cdot \\ \cdot \\ \frac{2h0x(L-1)}{\sigma} \end{bmatrix}$$

The expression $<x'|yi>$ for the ternary basis vectors yi can be obtained in the manner below: we calculate the expression:

$$-\langle H^t\left(\frac{2x}{\sigma}\right)|yi\rangle = F(yi)$$

The calculation procedure as represented by virtue of the operator in FIG. 6 makes it possible, in a similar way to the calculation of partial responses SL−1(yi) described previously, to obtain the quantities x'0, x'L−m−1, x'L−2 and therefore the abovementioned scalar products, the null vector being replaced by the null value.

As far the determination and the assigning of the scale factor $\gamma i$ to each of the basis vectors yi are concerned, it will be recalled that each scale factor $\gamma i$ can be determined from a plurality N of frame (sic), from a speech-signal database, the scale factor $\gamma i$ for each basis vector yi being selected so as to minimize for the relevant frame the filtering residue from the abovementioned frames. It will be recalled that several procedures for determining each scale factor $\gamma i$ can be envisaged.

By way of non-limiting example, in the case of basis vectors of ternary type and of dimension L=5, the list of scale factors $\gamma i$ is given beneath the table of the 121 values of the scale factors. The first value multiplies (−1, −1, −1, −1, −1), . . . , the last (0,0,0,0,−1).

| |
|---|
| 1.50, 1.66, 1.77, 1.28, 1.46, 1.36, 0.86, 2.47, 1.68, 1.51, |
| 1.12, 1.04, 1.38, 1.86, 1.51, 4.23, 3.47, 1.96, 1.25, 2.28, |
| 0.77, 2.50, 3.51, 0.87, 1.11, 1.16, 0.95, 1.29, 1.23, 1.85, |
| 1.34, 1.55, 1.60, 1.51, 1.44, 1.21, 1.45, 1.95, 1.45, 1.73, |
| 4.06, 1.73, 1.32, 1.39, 2.43, 1.38, 4.62, 1.35, 1.92, 2.15, |
| 1.44, 2.20, 1.95, 1.07, 0.88, 1.56, 1.48, 1.33, 1.64, 1.70, |
| 1.44, 3.33, 1.10, 1.89, 0.80, 2.07, 1.27, 1.57, 3.82, 1.28, |
| 1.31, 1.34, 1.94, 1.86, 1.25, 1.06, 2.15, 1.39, 0.89, 1.24, |
| 1.32, 1.17, 1.45, 0.57, 1.28, 2.00, 4.88, 2.14, 2.98, 2.24, |
| 1.23, 1.66, 1.41, 1.82, 3.44, 1.14, 3.15, 3.91, 1.60, 0.95, |
| 1.74, 1.50, 1.12, 2.98, 1.16, 1.23, 1.34, 1.00, 2.06, 2.52, |
| 4.52, 1.93, 2.89, 3.21, 1.39, 2.44, 2.38, 4.55, 3.00, 2.49, |
| 3.17 |

With the optimal values for the indices k* and i* having been determined and numbered in forward or backward fashion as described earlier in the description, as far as concerns in particular the value of the indices i, the speech transmission at low throughput is performed by just transmitting, as code signal, the values of the indices k* and i* representing each reference vector vk*,i*.

Insofar as the transmission of the abovementioned indices k* and i* is concerned, it will be noted that the transmission can be performed with the aid of conventional transmission protocols in which a redundancy of the transmitted information is introduced so as to ensure transmission at a substantially null error rate. It will evidently be understood that the value i* may be transmitted either with forward numbering or with backward numbering, namely according to a converted numbering whose conversion table is known by the coder and by the decoder alike.

A more detailed description of the procedure for decoding the transmitted information, that is to say the code signal transmitted in this way in accordance with the method which is the subject of the invention, will now be given in connection with FIG. 7.

In accordance with the abovementioned FIG. 7, the decoding procedure consists in distinguishing at 1,000 the values of the indices k* and i* constituting the code signal, and in decomposing at 1,001 the value of the index i* representing the optimal reference vector to base n so as to regenerate the corresponding basis vector yi*.

Regeneration of the basis vector yi* is performed at 1,002 from the value of the index i* and of the corresponding scale factor $\gamma i^*$, a correction of the corresponding regenerated basis vector being performed in order to build up the reference vector vk*,i*=$\gamma i^*$.yi*.

Following the abovementioned operation, the decoding procedure consists in performing a filtering operation 1003 for synthesizing the reference vector in order to generate the reconstructed speech signal.

It will of course be noted that, as in the case of the coding procedure, in the coding procedure (sic) of . the method which is the subject of the present invention, each reference vector vk*,i* is weighted, prior to the synthesizing filtering, by a predicted level factor $\sigma$ which is estimated over at least three successive earlier excitation vectors. The determination of the predicted level $\sigma$ will not be described in detail since it corresponds, at the decoding procedure level, to operations normally known to the expert.

A more detailed description of a system for transmitting a speech signal at low throughput in accordance with the subject of the present invention will be described in connection with FIGS. 8 and 9.

According to FIG. 8, the coding circuit comprises a generator 1 of a first dictionary Y of basis vectors yi of n-ary form of dimension L, the components of these vectors, as mentioned earlier, being able to take values included between −n/2 to n/2. It will of course be noted that the generator of the dictionary Y may advantageously consist of calculating means comprising the operators as described in FIGS. 3*a*, 3*b* for example and/or a memory circuit which can consist of a random-access memory associated with this calculating circuit or of a read-only memory. In this case, the read-only memory is associated with a fast sequencer which makes it possible to perform a successive reading of the basis vectors yi according to forward or backward numbered indices as described earlier.

Moreover, the coding circuit as represented in FIG. 8 comprises a circuit 2 correcting the basis vectors yi by a scale factor $\gamma i$. The correcting circuit can consist of a table of values stored in read-only memory, this correcting circuit making it possible to generate a corrected basis vector denoted by yi=$\gamma i$.yi for each basis vector yi. A fast multiplexer denoted by MUX makes it possible to successively read the corresponding values of the corrected basis vector $\overline{yi}0$ and to deliver this corresponding value to a circuit 3 generating a second dictionary of adaptive gain gk. Conventionally, the circuit 3 generating the second dictionary G(y) can advantageously comprise an amplifier circuit, denoted by 30, connected with a table of values gk constituting the second abovementioned dictionary. Thus, the circuit 3 generating the second dictionary G(y) delivers the reference vectors vk,i=gk.$\gamma$i.yi.

It will of course be noted that the coding circuit which is the subject of the present invention likewise comprises an amplifier circuit 4 which makes it possible to apply to each reference vector vk,i the level-prediction coefficient $\sigma$ as this latter has been defined previously in the description.

Furthermore, and conventionally, the coding circuit which is the subject of the present invention then comprises, disposed in cascade, the synthesizing filter denoted by 5 and the perceptual weighting filter denoted by 6 with transmission H as described previously in the description. An adder 7 makes it possible to receive, on the one hand, the original signal via the same perceptual weighting filter 6 after inversion the difference in the signals delivered by the adder 7, algebraic adder, making it possible to apply the minimum distortion criterion to the signal thus obtained (sic).

For this purpose, the coding circuit which is the subject of the present invention comprises a circuit for calculating the minimum distortion 8, which comprises a first circuit 80 calculating the product $$2gk < \frac{x}{\sigma} \mid H \cdot \gamma i \cdot yi >$$

in which the expression $$< \frac{x}{\sigma} H \cdot \gamma i \cdot yi >$$

designates the scalar product of the target vector x and of the reconstituted and perceptually weighted vector obtained through the product of the matrix H and of the corrected basis vector $\gamma i$ yi. The first calculating circuit 80 delivers a first calculation result r1.

A second calculating circuit 81 makes it possible to perform the calculation of the energy of the reconstituted and perceptually weighted vector, this energy being of the form $gk^2 \| H.\gamma i.yi \|^2$.

It will be noted that the calculating circuits 80 and 81 can consist of program modules whose calculation charts were made explicit respectively in FIGS. 4 and 5 a) to d) respectively. The second calculation circuit 81 delivers a second calculation result denoted by r2. A comparator 83 makes it possible to compare the value of the calculation results r1 and r2, thus making it possible to determine by distinguishing the values of the indices i and k, the indices i* and k* for which the criterion of minimum square deviation is satisfied. The distinguishing of the indices i* and k* is performed for example by a sort program denoted by 84 in FIG. 8. The values of the indices k* and i* are then delivered, these indices representing the corresponding reference vector vk*,i*.

In FIG. 8 the transmission circuit in accordance with the subject of the present invention has also been represented, this transmission circuit making it possible to deliver in the guise of code signal representing the speech signal just the values of the indices k* and i*. This transmission circuit does not exhibit any particular characteristic insofar as it may in fact consist of a transmission system of conventional type used in devices for transmitting speech signals by CELP type coding of the prior art.

A more detailed description of a decoding circuit making possible the implementation of the method which is the subject of the invention is represented in FIG. 9.

In accordance with the abovementioned FIGURE, the decoding circuit comprises a module 10 for distinguishing the values of the indices i*, k* of the code signal received, the code signal being of course transmitted according to a particular protocol which does not come under the subject of the present invention. Furthermore, as the distinguishing circuit 10 thereby performs a series parallel transformation of the information relating to the indices i*,k*, the decoding circuit comprises a circuit for decomposing to base n the value of the index i*.

It will of course be understood that the index k* is processed in parallel manner. For this purpose, the decoding circuit as represented in FIG. 9 comprises a table of adaptive gain values Gk denoted by 11, which, on receiving the value of the index k*, makes it possible to deliver the corresponding adaptive gain value gk*. This circuit 11 may advantageously consist of a read-only memory in which the adaptive gain values gk are stored.

Furthermore, a circuit 12 generating the scale factor $\gamma i^*$ is provided. This circuit may consist of a read-only memory forming a look-up table which makes the value $\gamma i^*$ correspond with the value i*. A multiplier circuit 12a makes it possible to generate a product coefficient $A = \sigma.gk^*.\gamma i^*$ from the values $\gamma i^*$,gk* and from the predicted level coefficient $\sigma$.

As has likewise been represented in FIG. 9, the decoding circuit comprises a circuit 13 generating the regenerated basis vector $\hat{yi}^*$ by decomposition to base n of the value of the index i*. For this purpose, a circuit 14 makes the value $\{-n/2, \ldots, 0, \ldots n/2\}$, correspond to the value i* by transcoding to base n the components of the index value i*, this making it possible to generate a regenerated reference vecto $\hat{vk}^*,i^*$ from the product of the regenerated basis vector $\hat{yi}^*$ and of the product A.

A synthesizing filter 15 makes it possible, from the pregenerated reference vector $\hat{vk}^*,i^*$, to generate the reconstructed speech signal.

The functioning of the decoding circuit as represented in FIG. 9 can be summarized in the manner below according to a preferred functioning.

The double multiplication produced at the level of the multiplier 12 gives an amplitude factor denoted by $A = \sigma.gk^*.\gamma i^*$.

If the index i* of the ternary vector transmitted corresponds to backward numbering, then we put $$i' = \frac{3^L - 3}{2} - i^*$$

and synthesis of the excitation vector or reconstituted reference vector vk*,i* is performed as follows:

current step (j,t), if j modulo 3 equals 0 then vk*,i* (L−1−t)=−A, if j modulo 3 equals 1 then vk*,i* (L−1−t)=0, if j modulo 3 equals 2 then vk*,i* (L−1−t)=A where vk*,i* (L−1−t) represents the component of vk*,i* to order L−1−t.

It will be noted that j is divided by 3, integer division, and t is increased by 1, addition of 1 to an integer number.

The first step is initialized by j=i' and t=0.

Of course, the current step is repeated until t=L−1, inclusive.

If on the contrary i* originates from a forward numbering, as described previously, then i'=i and the operations on j modulo 3 are performed as mentioned previously.

There has thus been described a method and a system of transmitting speech at low throughput which is particularly powerful insofar as a significant advantage lies in the fact that the dictionary Y has not had to be stored at decoder level. Thus only the indices of the reference vector are transmitted to the decoder, a calculation making it possible in real time to reconstitute the corresponding reference vector, this allowing a saving of memory facility at the level of each decoder used. Furthermore, and by reason of the procedures for generating the basis vectors, and the procedures for calculating the scalar products and the perceptual energies, neither is it necessary to store the basis vectors at coder level, this allowing a substantial saving in implementational hardware.

It will likewise be understood that the calculation algorithms described in the description of the subject of the present invention make it possible to obtain a very high calculation speed through rationalizing the calculation operators used, and simplifying the hardware required for their implementation.

It will finally be noted that the method and the system for transmitting a coded speech signal at low throughput which are the subject of the present invention have been described in the case where the CELP type. coding employs basis vectors of n-ary type, the number n being unrestricted in principle. Of course, a preferred embodiment has been given in the case where $n=3$, the basis vectors then being ternary vectors.

However, it has been possible to produce an embodiment based on the same principle for vectors for which $n=5$. The dictionary Y is then produced from an alphabet with five symbols, the values obtained being for example, in a non-limiting manner, the symbol 0, the symbol 0.5 and the symbol 1 plus the symmetrical symbols $-0.5$ and $-1$, which may be reduced to arbitrary integer values by changing scale.

In the implementation of a dictionary with five symbols, it has thus been possible to produce a method and a system of transmission at variable throughput which can attain up to 24 Kbits per second.

I claim:

1. A method of transmitting a speech signal at low throughput comprising using a coding circuit for coding digital samples of speech by code excited linear prediction from an excitation signal of a given excitation energy, in order to generate a code signal, said method including the steps of transmitting said code signal and decoding the transmitted code signal, and said coding step comprising using a first perceptual weighting circuit, having a given transfer function, to receive said digital samples of speech as an original vector of dimension L and to deliver a target vector $\chi$ of same dimension, using a first memory means to store a first dictionary of base vectors yi and a second memory means to store a second dictionary of gain values gk, using said base vectors yi and said gain values gk to generate a reference vector $v_{k,i}=yi.gk$, using a synthesizing filter and a second perceptual weighting circuit having the same transfer function as the first perceptual weighting circuit and connected in series with said synthesizing filter to produce, based on said reference vector, a resultant transfer function H of the form of a pulse response matrix of dimension $L\times L$, said second perceptual weighting circuit delivering a perceptually weighted reconstituted vector or synthesized wave form, receiving said perceptually weighted reconstituted vector and said target vector and applying a criterion of minimum square deviation of said original vector in relation to said synthesized waveform or reconstituted reference vector, said criterion of minimum square deviation being of the form min $\|\chi-H.v\|^2$, said method further comprising:

establishing a factorized dictionary of said first dictionary of basis vectors yi of n-ary form $\{-n/2, \ldots, o, \ldots n/2\}$, n being an odd number and n/2 designating the integer part obtained through division of n by two, correcting said basis vectors by a scale factor $\gamma i$, which takes into account the distribution of excitation energy in the frequency domain of the signal, so as to generate corresponding corrected basis vectors $\gamma i.yi$ establishing a dictionary of reference vectors factorized as a product of said second dictionary of adaptive gains gk and said corrected basis vectors $\overline{yi}=\gamma i.yi$, reference vectors of indices i, k being of the form $v_{k,i}=gk.\gamma i.yi$, applying said reference vectors to the series connected synthesizing filter and second perceptual weighting circuit to generate said perceptually weighted reconstituted vector or synthesized waveform, establishing said minimum value of minimum square deviation between said target vector and said weighted reconstituted vector in the form min $\|\chi-gk.H.\gamma i^*.yi^*\|^2$ for the maximum of $C(gk,.\gamma i.yi)=2\ gk<\chi|H.\gamma i.yi>-gk^2\|H.\gamma i.yi\|^2$ by calculating all the scalar products $<\chi|H.\gamma i.yi>$ and all the perceptual energies $\|H.y\|^2$ for particular given values i*, k* of said indices, and assigning to said original vector said corresponding reference vector $v_{k^*,i^*}=gk^*.\gamma i^*.yi^*$, said reference vector being represented only by said values of said indices i*, k* satisfying said minimum square deviation criterion.

2. The method as claimed in claim 1, wherein the said minimum value of the square deviation min $\|\chi-gk\ H.\gamma i.yi\|^2$ is evaluated by selecting the corresponding gain element gk of the second dictionary G(y) thereby enabling minimizing of the difference $g-gk^*$ where g satisfies the relation:

$$g=\frac{<\chi|H\cdot\gamma i\cdot yi>}{\|H\cdot\gamma i\cdot yi\|^2}.$$

3. The method as claimed in claim 1, wherein the said first dictionary Y comprising a set of basis vectors yi, of n-ary form $\{-n/2, \ldots, o, \ldots n/2)$ of dimension L comprises all the basis vectors whose L components have the value of one of the values $(-n/2, \ldots, o, \ldots n/2)$ excepting a null vector, the index i of the basis vectors being made equal to the base n value of each basis vector after transcoding of the values $(-n/2 \ldots, 0, \ldots n/2)$ into a corresponding value $(0,1,2 \ldots n)$.

4. The method as claimed in claim 3, wherein the basis vectors yi constituting the said first dictionary Y is defined from the n/2. L pulse vectors, of which a single component aj of order j with $j\epsilon[0,L-1]$ is equal to $-1$, $-2 \ldots -n/2$, each pulse vector being associated with the allied basis vectors having identical component values of order $q\leqq j$, each vector allied to a pulse vector of rank q with $q=j$ for $aj\neq O$ being obtained by linear combination of the pulse vector of rank q and of the pulse or allied vectors of higher rank q.

5. The method as claimed in claim 1, wherein, for each basis vector yi, the scale factor $\gamma i$ associated with that basis vector is determined experimentally, from a plurality N of frames comprising L speech-signal values and forming a database, the scale factor $\gamma i$ for each basis vector yi begin selected in such a way as to minimize, for a corresponding relevant frame, the filtering residue from the said frames.

6. The method as claimed in claim 1, wherein, in order to ensure the transmission of the speech signal at low throughput, the transmission procedure comprises transmitting as code signal only values of the indices (k*,i*) representing each reference vector vk*,i*.

7. The method as claimed in claim 1, wherein, in order to ensure the decoding of the code signal, said method further comprises:

distinguishing the values of the indices k*,i* constituting the code signal, decomposing the value of the index i*, representing the optimal reference vector to base n in order to regenerate the corresponding basis vector yi*, performing, from the corresponding value of the index i* and of the corresponding scale factor $\gamma i^*$, a correction of the corresponding regenerated basis vector in order to build up the reference vector $v_{k^*,i^*}=\gamma i^*.yi^*$, and performing a synthesizing filtering operation of the reference vector in order to generate a reconstructed speech signal.

8. The method according to claim 1, wherein prior to the synthesizing filtering, each reference vector $v_{k^*,i^*}$ is weighted by a predicted level factor $\sigma$ representing the average said excitation signal estimated over at least three successive earlier excitation vectors.

9. A system for transmitting a speech signal at low throughput comprising a coding circuit for coding digital samples of speech by code excited linear prediction from an excitation signal of a given excitation energy in order to generate a code signal, transmitter means for transmitting said code signal, receiver means for receiving the transmitted code signal, and a decoding circuit for decoding the transmitted code signal received by said receiver means, said coding circuit comprising:

a first perceptual weighting circuit, having a given transfer function, for receiving said digital samples of speech as an original vector of dimension L and for delivering a target vector $\chi$ of same dimension, a first memory means for storing a first dictionary of basis vectors yi and a second memory means for storing a second dictionary of adaptive gain values gk, multiplying means for receiving said basis vectors yi and said gain values gk and for generating a reference vector $v_{k,i}=yi.gk$, a synthesizing filter for receiving said reference vector $v_{k,i}$ and a second perceptual weighting circuit having the same transfer function as said first perceptual weighting circuit and connected in series with said synthesizing filter so as to provide a resulting transfer function H of the form of a pulse response matrix of dimension L×L, said second perceptual weighting circuit delivering a perceptually weighted reconstituted vector or synthesized waveform, and a circuit for receiving said perceptually weighted reconstituted vector and said target vector and for applying a criterion of minimum square deviation of said initial vector in relation to said synthesized waveform or designated reference vector, said criterion of minimum square deviation being of the form $\min \| \chi.H.v \|^2$, and said coding circuit further comprising:

a first dictionary generating means for generating said first dictionary in the form of basis vectors yi of n-ary form $\{-n/2, \ldots, 0, \ldots n/2\}$ of dimension L, correcting means for correcting the said basis vectors yi by a scale factor $\gamma i$, which takes into account the distribution of the excitation energy in the frequency of the signal and for generating a corrected basis vector $\overline{yi}=\gamma i.yi$ for each said basis vector yi, a second dictionary generating means for generating said second dictionary of adaptive gains jk, said second dictionary generating means comprising multiplier means for generating, based on said corrected basis vectors $\overline{yi}$ and said gain values gk, n reference vectors of indices i, k of the form $v_{k,i}=gk.\gamma i.yi$, first means for calculating the product $2gk<\chi|H.\gamma i.yi>$ where $<\chi|H.\gamma i.yi>$ designates the scalar product of said target vector $\chi$ and said perceptually reconstituted vector, and for delivering a first calculation result, second means for calculating the energy of said perceptually weighted reconstituted vector $gk^2 \| H.\gamma i.yi \|^2$ and for delivering a second calculation result, and means for comparing said first and second calculation results to thereby enable a determination to be made, by distinguishing given values i*, k* of said indices i,k for which said criterion of minimum square deviation is satisfied, the corresponding reference vector $v_{k^*i^*}$ with $v_{k^*,i^*}=gk^*,\gamma i^*.yi^*$ being represented by only values of said indices i*, k*.

10. The system as claimed in claim 9, wherein the transmission means enables circuit transmission, in lieu of a code signal representing the speech signal, just the values of the indices k* and i*.

11. The system as claimed in claim 9, wherein the decoding circuit comprises:

means for distinguishing the values of the indices i*,k* of the code signal received, means for generating a dictionary G(y) of adaptive gains gk* from the distinguished values k*, means for generating the corresponding scale factor $\gamma i^*$, multiplying means for generating a product coefficient $\sigma.gk^*.\gamma i^*$ from the values i*,gk* and from a predicted level coefficient $\sigma$ means for decomposing to base n the index value i*, means for generating the regenerated basis vector $\hat{yi}$ corresponding to the value i* by transcoding of the components to base n of the index value i*k each value n, . . . 2,1,0 of the expression to base n of the index value i* being associated with respectively the value $\{-n/2, \ldots 0, \ldots n/2)$, there enabling generation of a regenerated reference vector $\hat{y}k^*,i^*$, a synthesizing filter enabling, on the basis of the regenerated reference vector $\hat{y}k^*i^*$, generation of a reconstructed speech signal.

12. The system as claimed in claim 9, wherein said coding circuit further comprises, upstream of the synthesizing filter, a circuit for correcting the reference vector vk*,i* by a predicted level factor representing the average energy of the excitation signal estimated over at least three successive earlier excitation vectors.

* * * * *